US006745649B1

(12) United States Patent
Liao

(10) Patent No.: US 6,745,649 B1
(45) Date of Patent: Jun. 8, 2004

(54) SOCKET FOR A WRENCH

(76) Inventor: Hui-Chen Liao, No. 14, Lane 155, Sec. 3, Hsi-Tun Rd., Taichung (TW)

( * ) Notice: Subject to any disclaimer, the term of this patent is extended or adjusted under 35 U.S.C. 154(b) by 0 days.

(21) Appl. No.: 10/429,649

(22) Filed: May 5, 2003

(51) Int. Cl.[7] ..... B25B 13/06

(52) U.S. Cl. ..... 81/121.1; 81/58; 81/186; 81/124.6

(58) Field of Search ..... 81/121.1, 186, 81/119, 124.3, 124.6, 124.7, 177.1, 53.2, 441, 58, 124.5; 411/403, 402, 404, 405, 410; D8/21, 28, 29

(56) References Cited

U.S. PATENT DOCUMENTS

| | | | | | |
|---|---|---|---|---|---|
| 811,925 | A | * | 2/1906 | Jackson | 411/427 |
| 838,109 | A | * | 12/1906 | Hanes et al. | 81/124.4 |
| 2,460,766 | A | * | 2/1949 | Peterson | 81/128 |
| 2,697,370 | A | * | 12/1954 | Brooks | 81/58 |
| 3,273,430 | A | * | 9/1966 | Knudsen et al. | 81/124.6 |
| 3,299,750 | A | * | 1/1967 | Campanile et al. | 81/62 |
| 4,512,220 | A | * | 4/1985 | Barnhill et al. | 81/121.1 |
| 4,616,535 | A | * | 10/1986 | Chiavon | 81/121.1 |
| D379,053 | S | * | 5/1997 | Howard | D8/21 |
| 5,832,792 | A | * | 11/1998 | Hsieh | 81/124.6 |
| 6,098,501 | A | * | 8/2000 | Sundstrom | 81/121.1 |
| 6,276,242 | B1 | * | 8/2001 | Wiggins et al. | 81/176.15 |

* cited by examiner

*Primary Examiner*—Hadi Shakeri
(74) *Attorney, Agent, or Firm*—Alan D. Kamrath; Nikolai & Mersereau, P.A.

(57) ABSTRACT

A socket for a wrench has a body with a central hole defined in one end of the body and a connecting device formed on the second end of the body. Multiple first protrusions are formed on the inner surface of the central hole, and each first protrusion has a peak with a first angle. A second protrusion is formed on the inner surface of the central hole between each pair of adjacent first protrusions. Each second protrusion has a peak with a second angle and a recess to make the second angle smaller than the first angle of the peak of the first protrusions. With such a socket, the socket can securely hold the head of the fastener with the peaks on the protrusions even when the head has been worn away.

7 Claims, 6 Drawing Sheets

SOCKET FOR A WRENCH

BACKGROUND OF THE INVENTION

1. Field of the Invention

The present invention relates to a socket, and more particularly to a socket for a wrench and that can securely hold a head of a fastener to rotate the fastener even when the head has been worn away.

2. Description of Related Art

A socket can be attached to a wrench to hold and to rotate a fastener, such as a bolt or a nut. A conventional socket has a body with a central hole defined in one end of the body. A square hole is defined in the other end of the body to engage with a cubic stub protruding from the wrench, such that the socket can rotate with the wrench by means of the engagement between the stub and the hole. The central hole is polygonal and generally has six identical surfaces forming the central hole. The polygonal central hole can engage with a polygonal head of the fastener to drive the fastener to rotate with the socket so as to tighten or loosen the fastener relative to an object.

However, the central hole of the conventional socket cannot securely hold a head of a fastener when the head has been worn away. The worn head cannot be driven to rotate with the conventional socket, and so the use of the conventional socket is limited and is not versatile.

To overcome the shortcomings, the present invention tends to provide a socket to mitigate or obviate the aforementioned problems.

SUMMARY OF THE INVENTION

An objective of the invention is to provide a socket for a wrench and that can drive a head of a fastener even when the head has been worn away. The socket has a body with a central hole defined in one end of the body and a connecting device formed on the second end of the body. Multiple first protrusions are formed on the inner surface of the central hole, and each first protrusion has a peak with a first angle. A second protrusion is formed on the inner surface of the central hole between each pair of adjacent first protrusions. Each second protrusion has a peak with a second angle and a recess defined in one side of the second protrusion to make the second angle smaller than the first angle of the peak of the first protrusions. In such an arrangement, the socket can securely hold the head of the fastener with the peaks on the protrusions.

Other objectives and novel features of the invention will become more apparent from the following detailed description when taken in conjunction with the accompanying drawings.

DETAILED DESCRIPTION OF PREFERRED EMBODIMENT

Figure 1:
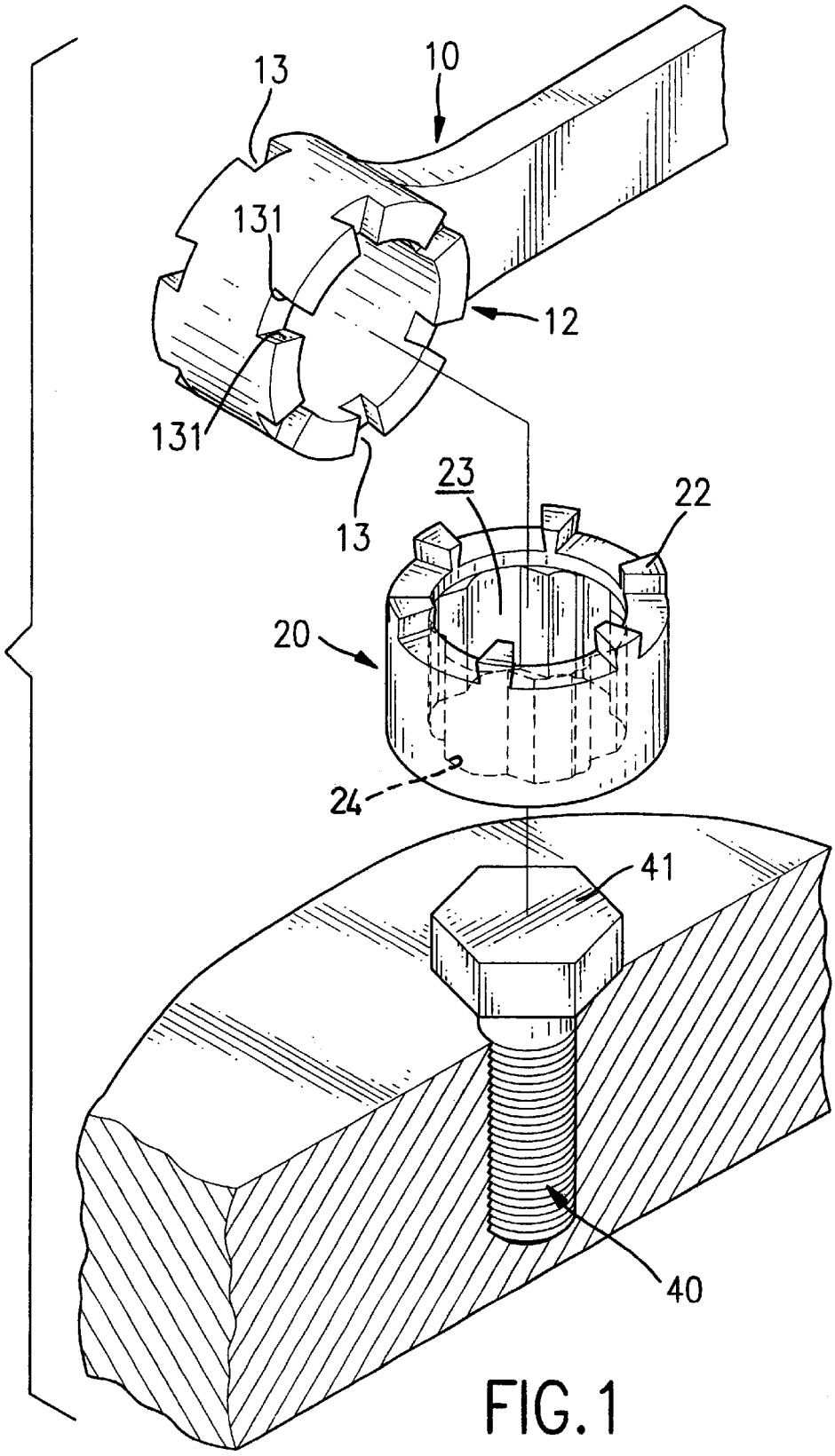
FIG. 1 is an exploded perspective view in partial cross section of an object with a fastener, a wrench and a socket in accordance with the present invention.
Figure 2:
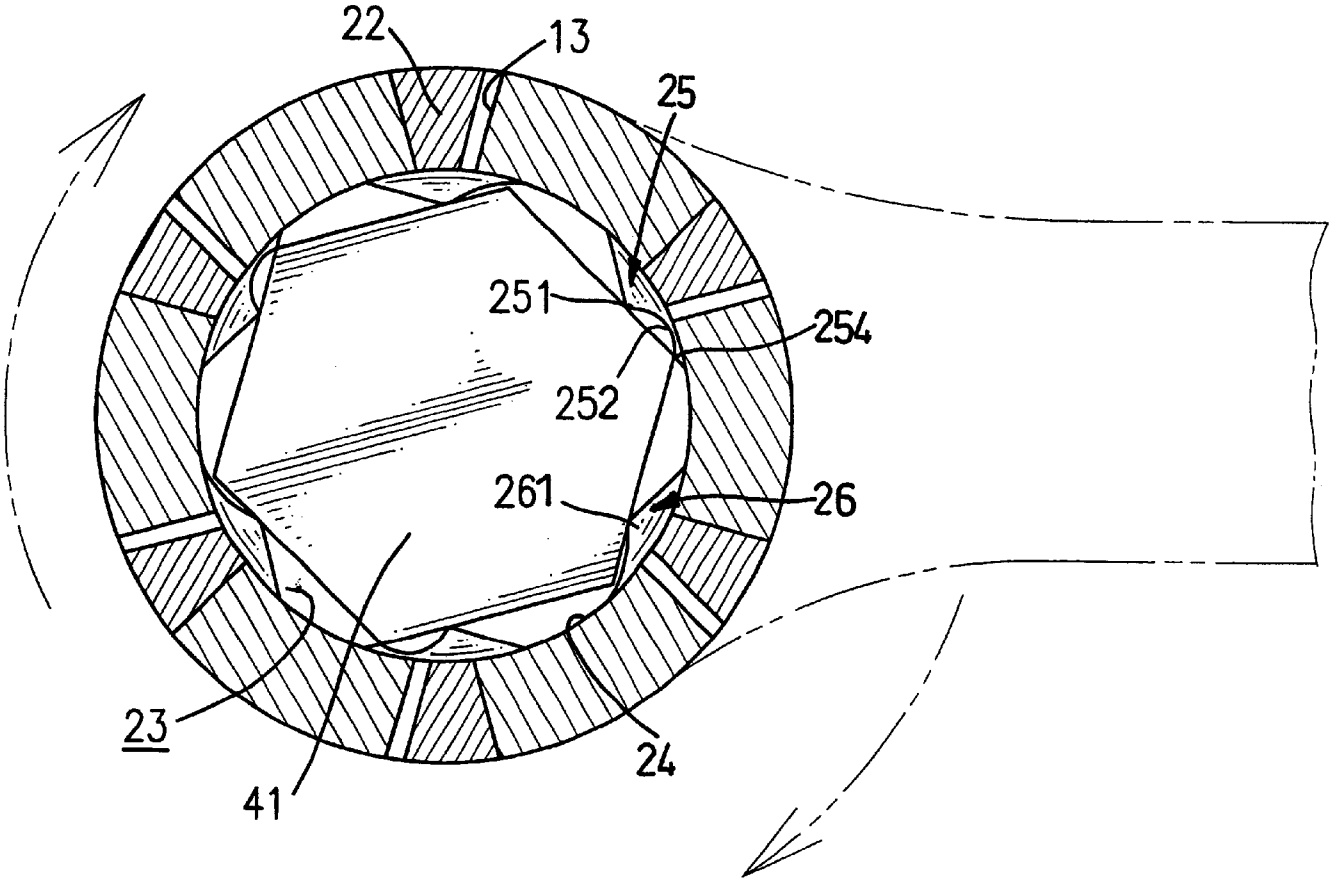
FIG. 2 is a top plan view in partial cross section of the fastener, the wrench and the socket in FIG. 1.

With reference to FIGS. 1 and 2, a socket (20) for a wrench (10) in accordance with the present invention comprises a body and a connecting device. The body has a first end, a second end and a central hole (23) with an inner surface defined in the first end. In a first embodiment, the central hole (23) is defined through the body from the first end to the second end. Multiple first protrusions (26) are formed on the inner surface defining the central hole (23). Each first protrusion (26) has a peak (261) with an angle. A second protrusion (25) is formed on the inner surface of the central hole (23) between each pair of adjacent first protrusions (26). A gap (24) is defined between each respective second protrusion (25) and the first protrusion (26) that is adjacent to the second protrusion (25). Each second protrusion (25) has a peak (251) with an angle and a recess (252) formed on one side of the second protrusion (25). With the arrangement of the recess (252), the angle of the peak (251) of each second protrusion (25) is smaller and sharper than that of the peak (261) on each first protrusion (26). An auxiliary peak (254) is formed on each second protrusion (25) at the side in which the recess (252) is defined.

The connecting device is formed on the second end of the body and is adapted to connect to the wrench (10). The connecting device comprises multiple engaging blocks (22) protruding from the second end of the body. Each engaging block (22) has two surfaces inclined with each other.

In practice, a tubular connecting head (12) is formed on a bend of the wrench (10), and multiple engaging recesses (13) are respectively defined in two sides of the connecting head (12) and respectively correspond to the engaging blocks (22) on the socket (20). Each engaging recess (13) has two inclined surfaces (131) respectively corresponding to the inclined surfaces on the corresponding engaging block (22). The engaging recesses (13) have a width larger than that of the engaging block (22), such that a gap is defined between each engaging recess (13) and the corresponding engaging block (22).

Figure 3:
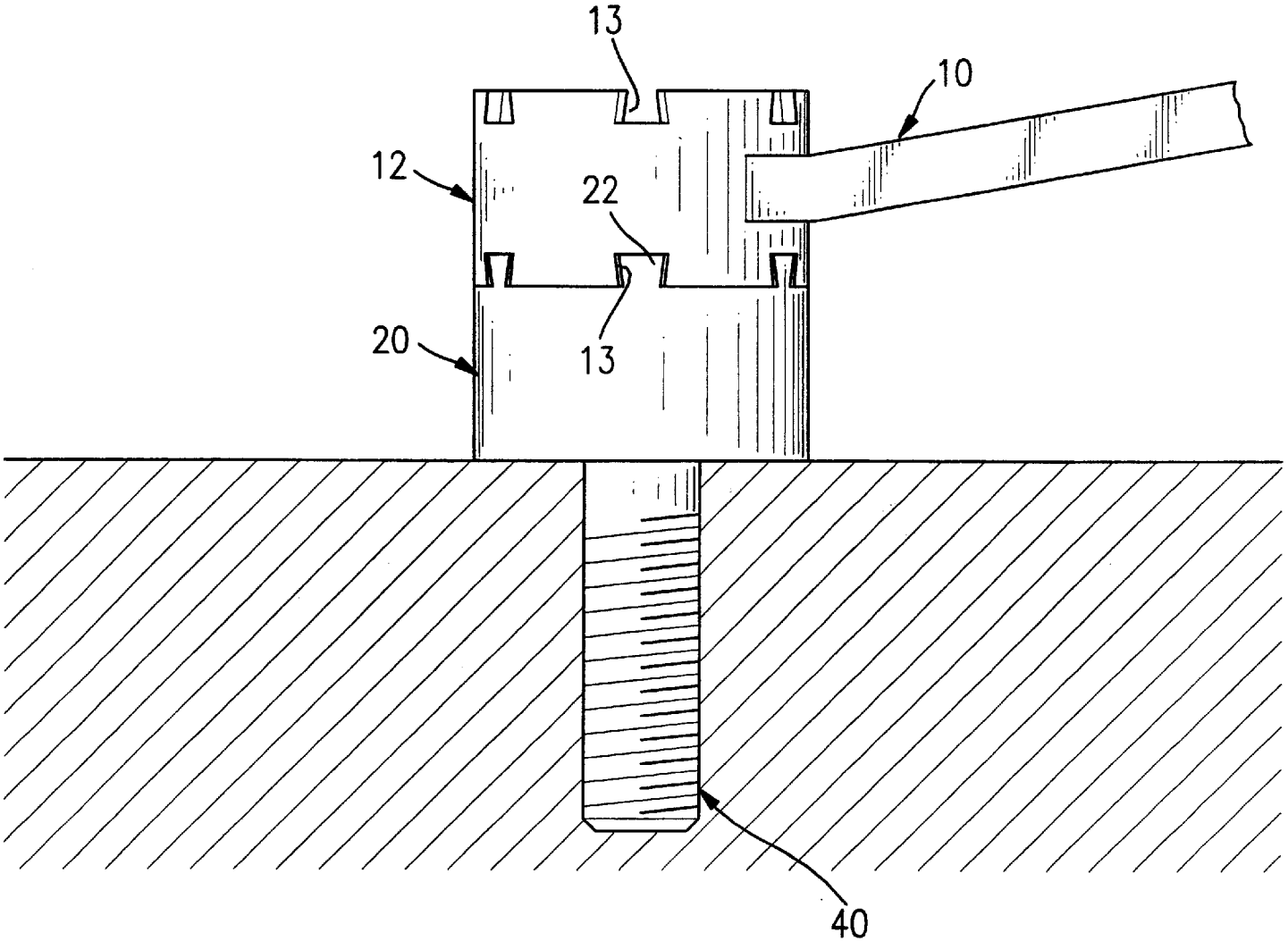
FIG. 3 is an operational side view in partial cross section of the object with the fastener, the wrench and the socket in FIG. 1.
Figure 4:
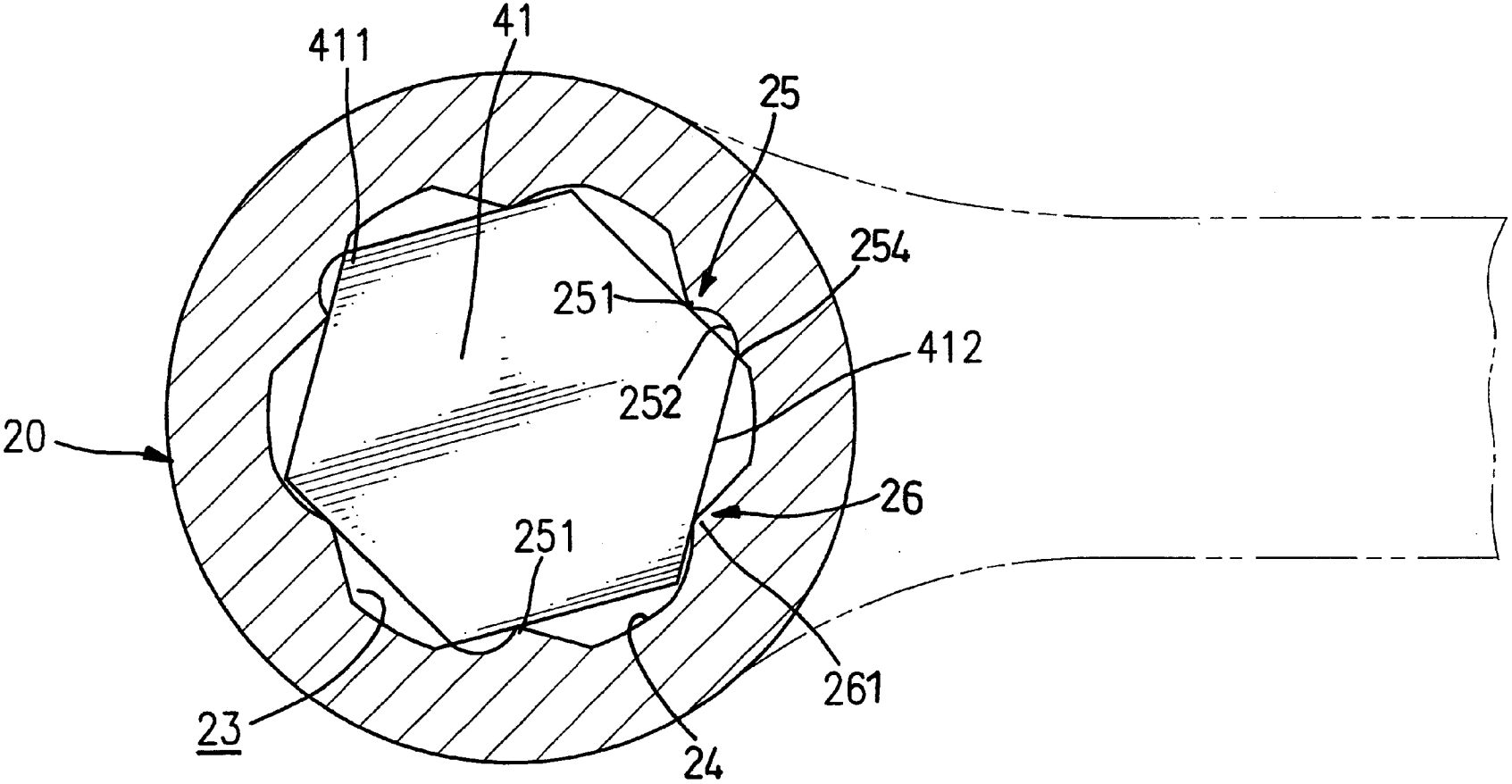
FIG. 4 is a top plan view in partial cross section of the socket engaging with the head of the fastener in FIG. 1.

With reference to FIGS. 2 to 4, to tighten or to loosen a fastener (40) with a polygonal head (41), the socket (20) is mounted onto the fastener (40) by the central hole (23) receiving the head (41). Corners (411) of the head (41) are respectively received in the gaps between the second protrusions (25) and the first protrusions (26). The peaks (251,254,261) on the first and second protrusions (25,26) abut against the edges (412) of the head (41). With the abutment between the peaks (251) on the socket (20) and the edges (412) of the head (41), the socket (20) can securely hold the head (41) in the central hole (23). Then, the wrench (10) is attached to the socket (20) with the engaging blocks (22) engaging with the engaging recesses (13) in the connecting head (12). Consequently, the fastener (40) is driven to rotate when the wrench (10) is rotated, and the fastener (40) will be tightened on or loosened from an object (not numbered). In addition, because the corners (411) of the head (41) of the fastener (40) are received in the gaps between the protrusions (25,26), wear of the corners (411) of the head (41) is prevented.

Figure 5:
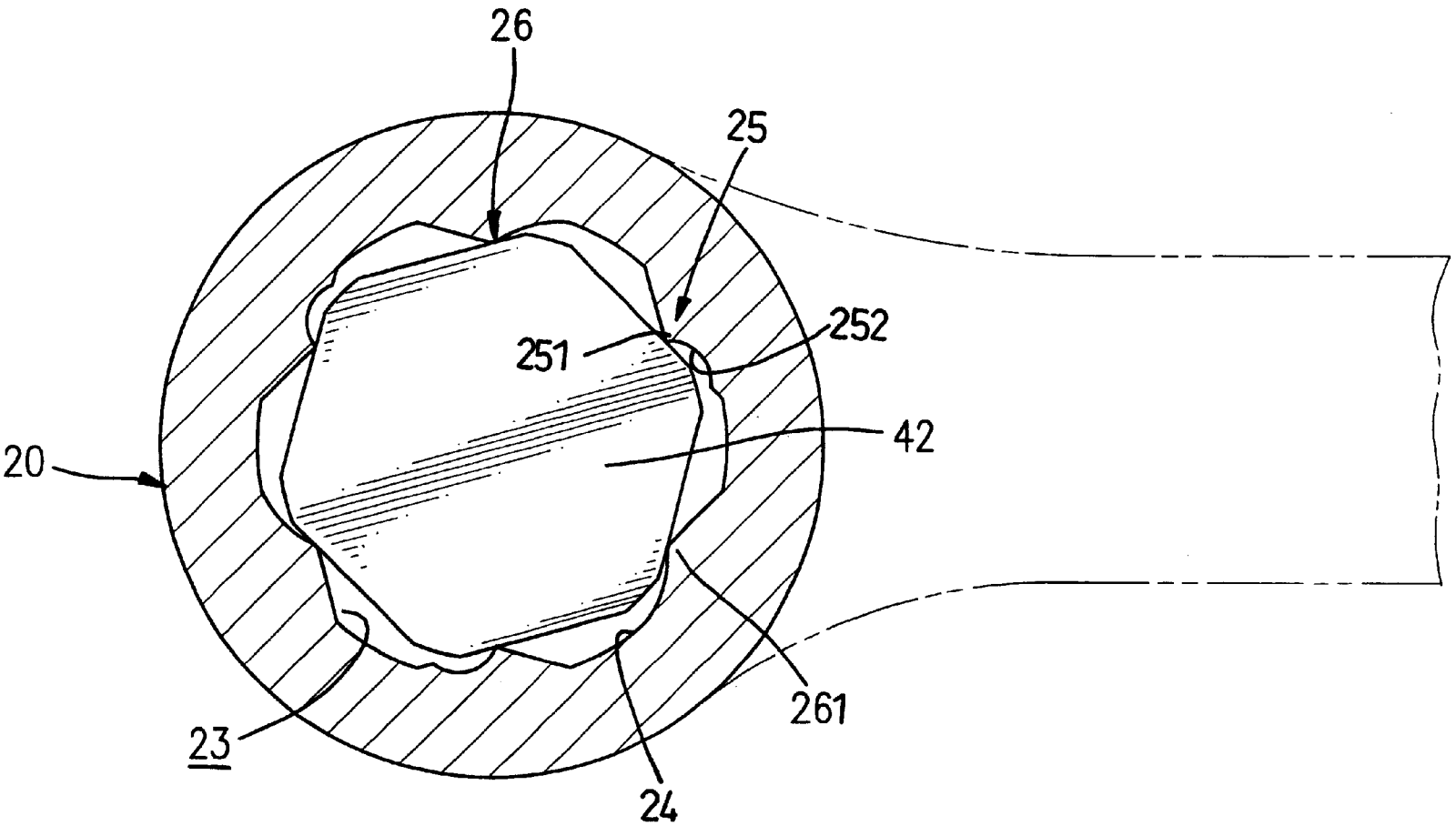
FIG. 5 is a top plan view in partial cross section of the socket in FIG. 1 engaging with a worn head.

With reference to FIG. 5, when the socket (20) is applied to rotate a fastener with a worn head (42), the sharper peaks (251) on the second protrusion (25) can provide a very secure engaging effect to the outer periphery of the worn head (42). The worn head (42) can be securely held and driven to rotate by the socket (20) in accordance with the present invention. Therefore, the socket (20) in accordance with this present invention can be used on a fastener with a worn head (42) even when the head (42) has been worn away to a rounded head.

Figure 6:
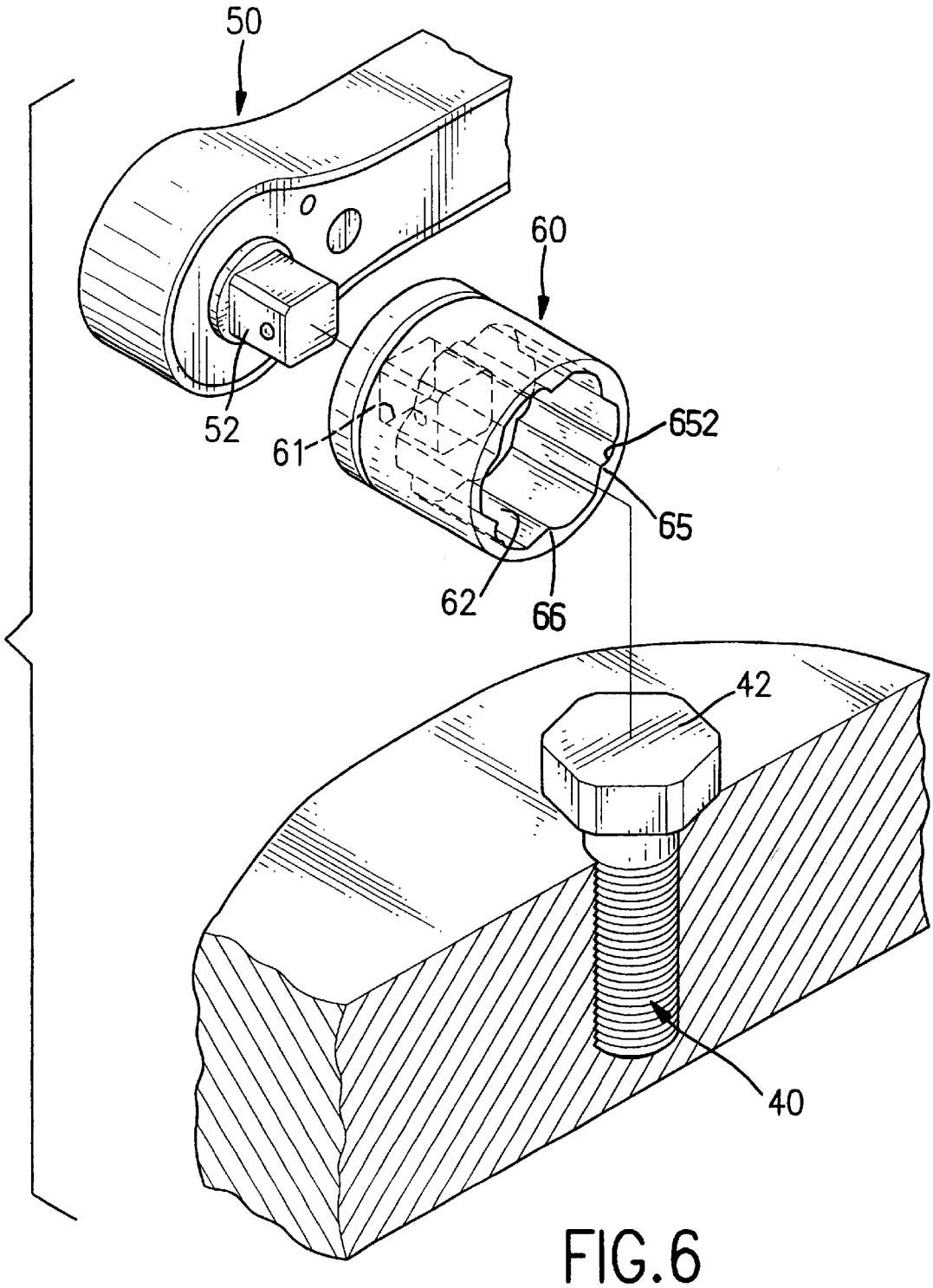
FIG. 6 is an exploded perspective view in partial cross section of an object with a fastener, a wrench and another embodiment of a socket in accordance with the present invention.

In a second embodiment, with reference to the FIG. 6, the socket (60) comprises a body and a connecting device. The body has a first end, a second end and a central hole (62) defined in the first end. Multiple first protrusions (66) and second protrusions (65) with sharp peaks are formed on the inner surface of the central hole (62). The first protrusions (66), second protrusions (65) and gaps (652) of this embodiment are the same as those of the first embodiment and are not further described. The connecting device is formed on the second end of the body and comprises a wall (not numbered) and a substantially square hole (61). The wall is formed on the second end of the body, and the square hole (61) is defined through the wall and communicates with the central hole (62) in the body. The square hole (61) can fit with a cubic stub (52) protruding from a connecting head of a wrench (50) to make the socket rotate with the wrench. With the arrangement of the protrusions (65,66), the socket (60) can be used to drive a fastener (40) with a worn head (42).

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A socket for a wrench comprising:

a body having an axial length, a first end and a second end along the axial length, with the body having a central hole extending from the first end, with the central hole having an inner surface defined in the first end of the body;

a connecting device formed on the second end of the body to be adapted to connect to the wrench;

multiple first protrusions formed on the inner surface of the central hole, with the multiple first protrusions spaced circumferentially and extending longitudinal the body, with each first protrusion of the multiple first protrusions having a peak with a first angle, with each first protrusion having a first side and a second side, with the peak defined by the interconnection of the first side and the second side, with the first side of each first protrusion being planar;

multiple second protrusions is formed on the inner surface of the central hole, with each second protrusion of the multiple second protrusions located between each pair of adjacent first protrusions, with each second protrusion having a peak with a second angle, a first side, a second side and a recess defined in the first side, with the peak of each second protrusion defined by the interconnection of the second side to the recess, with the recess having a radius to make the second angle of each peak of the second protrusion smaller than the first angle of the peak on each first protrusion, with the recess defining an auxiliary peak on the first side, with the recess being intermediate the peak and the auxiliary peak of each second protrusion; and a gap defined between each respective second protrusion and each respective first protrusion of each pair of adjacent first protrusions that is adjacent to the each second protrusion, with the auxiliary peak being intermediate the recess and an interconnection of the first side with the gap.

2. The socket as claimed in claim 1, wherein the second end has an opening and the central hole is defined through the body from the first end to the opening in the second end; and the connecting device comprises multiple engaging blocks spaced circumferentially and protruding longitudinally from the second end of the body radially exterior a perimeter of the central hole, with each engaging block of the multiple engaging blocks having two surfaces located opposite each other circumferentially and inclined with each other, with cross sections perpendicular to the axial length of each engaging block having a radial inside width between the two surfaces narrower than a radial outside width between the two surfaces.

3. The socket as claimed in claim 2, with the second side of each first protrusion being arcuate and concave.

4. The socket as claimed in claim 2, with radial cross sections parallel to the axial length of each engaging block having an axially inner width between the two surfaces narrower than an axially outer width between the two surfaces.

5. The socket as claimed in claim 1, wherein the connecting device comprises a wall formed on the second end of the body and a square hole defined through the wall and communicating with the central hole in the body, with the connecting device adapted to connect with a cubic stub protruding from a connecting head of the wrench.

6. The socket as claimed in claim 5, with the second side of each first protrusion being arcuate and concave.

7. The socket as claimed in claim 1, with the second side of each first protrusion being arcuate and concave.

* * * * *